United States Patent [19]

Jörn et al.

[11] 4,205,721

[45] Jun. 3, 1980

[54] APPARATUS FOR FILLING A CASTING MOLD

[75] Inventors: Alfred Jörn, Bibern; Max Wernli, Schaffhausen, both of Switzerland

[73] Assignee: Georg Fischer Aktiengesellschaft, Switzerland

[21] Appl. No.: 886,060

[22] Filed: Mar. 13, 1978

[30] Foreign Application Priority Data

Mar. 23, 1977 [CH] Switzerland ..... 3709/77

[51] Int. Cl.[2] ..... B22D 33/04

[52] U.S. Cl. ..... 164/335; 164/363; 164/364

[58] Field of Search ..... 164/6, 14, 33, 138, 164/72, 113, 119, 133, 134, 135, 136, 284, 303, 335, 336, 337, 363, 244, 364; 141/115, 284, 332, 335, 337-339; 249/108, 205

[56] References Cited

U.S. PATENT DOCUMENTS

| | | | |
|---|---|---|---|
| 2,269,455 | 1/1942 | Hagemeyer | 164/364 |
| 2,310,766 | 2/1943 | Dornauf | 164/284 |
| 2,949,637 | 8/1960 | Holowaty et al. | 164/335 |
| 3,572,421 | 3/1971 | Mezey et al. | 164/244 |
| 3,844,337 | 10/1974 | Bessett et al. | 249/205 |
| 4,008,749 | 2/1977 | Bellocci et al. | 164/119 |

FOREIGN PATENT DOCUMENTS

| | | | |
|---|---|---|---|
| 810653 | 3/1959 | United Kingdom | 222/591 |

*Primary Examiner*—Robert D. Baldwin
*Assistant Examiner*—K. Y. Lin
*Attorney, Agent, or Firm*—Roylance, Abrams, Berdo & Farley

[57] ABSTRACT

A filling apparatus includes a melt container with a bottom outlet spout and an interior closure plug. In certain embodiments the spout has a conical end. A casting mold has a pouring gate and channel. The container is supported by an elevating mechanism and either the container or the mold can also be movable horizontally to permit alignment of the spout and gate. A separatory body is between the spout and gate, several embodiments being disclosed including a layer of material formed on the spout and a conical member in a recess at the gate, the conical member being shaped to receive the conical end of the spout during filling. The separating member of the mold includes a receptacle having a volume greater than the volume of the spout bore below the closure plug to accept melt therefrom after filling.

11 Claims, 8 Drawing Figures

APPARATUS FOR FILLING A CASTING MOLD

This invention relates to an improved apparatus for filling a casting mold with melt.

BACKGROUND OF THE INVENTION

A prior art apparatus for filling a casting mold is shown in German Offenlegungsschriften No. 2,343,036, wherein two hollow bodies are telescopically shiftable relative to each other and a sliding seal is interposed, in the mold-filling position, between a bottom outlet of a pouring ladle and the pouring gate of the casting mold. In order to avoid oxidation of the outflowing melt, a protective gas is fed into the inside of one of the hollow bodies. An annular guard plate is disposed around the pouring gate for protection against splashes of the melt.

Since the jet of melt in its free-fall passes from the pouring ladle into the pouring gate, an arrangement for precise dosing of the existing melt, corresponding to the volumetric capacity of the casting mold, is indispensible. Thus, both an overflowing of the pouring gate as well as the formation of turbulences in the pouring channel may be positively prevented. As is well known, however, such dosing mechanisms are very expensive and require a correspondingly expensive and complex maintenance.

BRIEF DESCRIPTION OF THE INVENTION

Accordingly, the present invention has as its goal the provision of a simple arrangement requiring little maintenance for filling of casting molds with melt using a melt container with a plug-type of closure and wherein the casting mold itself is provided with as small as possible a pouring gate or funnel. Thus, the quantity of melt being supplied to the casting mold can be adapted to a variety of molds having a wide variety of volumetric capacities without expensive dosing elements. In addition, the apparatus of the present invention provides a filling system which prevents the possibility of oxidation of the melt without the need for protective gas.

Briefly described, the invention includes an improved apparatus for filling a casting mold with melt, the apparatus being of the type having a melt container having at least one bottom outlet and a closure plug and the casting mold having at least one pouring channel and pouring gate opening at the upper surface of the casting mold, wherein the improvement includes means for supporting the melt container and the casting mold so that at least one of the container and mold is movable relative to the other to align the bottom outlet with the pouring gate, and a separating body disposed between the bottom outlet and the pouring gate for passage of melt therethrough.

Stated differently, the invention includes an improved apparatus for filling a casting mold with melt comprising the combination of a melt container having a bottom outlet, said outlet including an outlet spout protruding downwardly from a bottom surface of said container and having a central bore through which melt can pass, and a closure plug in said container, said plug being movable toward and away from the inner end of said bore to selectively permit passage of melt therethrough; a casting mold including a mold cavity to be filled with melt from said container, a pouring gate at an upper surface of said mold to receive melt from said spout, and a pouring channel interconnecting said gate and said cavity; means for supporting said melt container and said casting mold for relative movement therebetween to permit alignment of said bore and said gate and to permit said spout to be moved into mating proximity with said gate; and a separatory body carried by one of said spout and said gate and having an opening therethrough to facilitate separation of said spout from said gate after filling said cavity, said spout, said gate and said separatory body being shaped to closely mate with each other so that they can be brought into mutual contact with said body between said spout and said gate whereby melt can pass directly from said spout through said body and into said gate.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
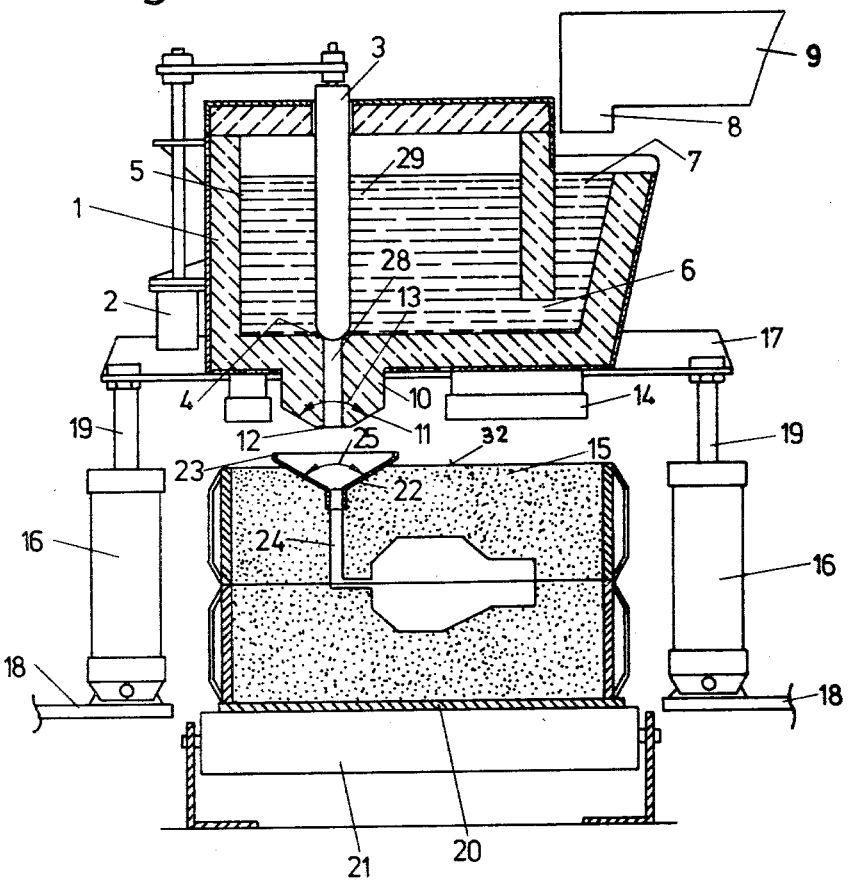
FIG. 1 is a schematic side elevation, in partial section, of a first embodiment of an apparatus in accordance with the invention in a position prior to filling of a casting mold.
Figure 2:
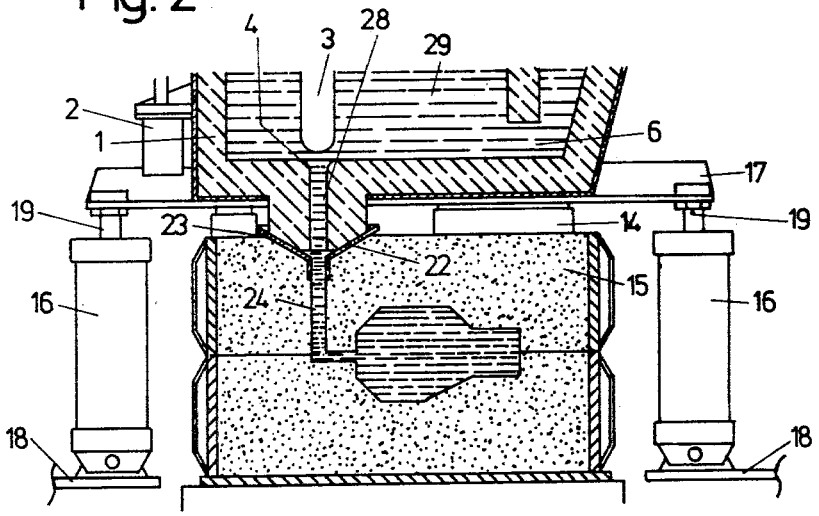
FIG. 2 is a side elevation, in partial section, of the apparatus of FIG. 1 showing the apparatus in a position with the mold cavity filled.
Figure 3:
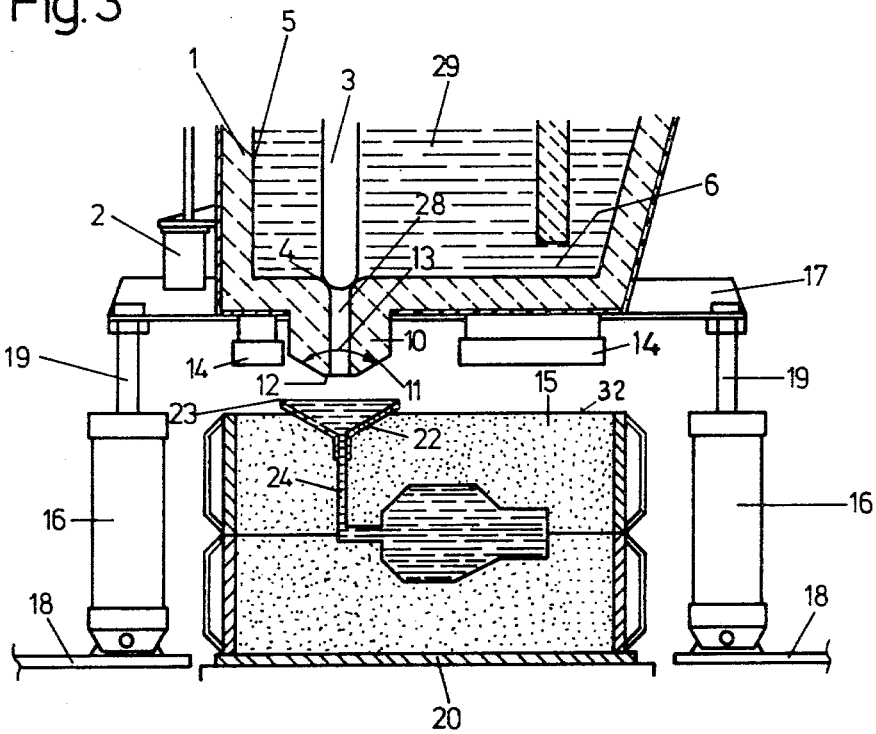
FIG. 3 is a view of the apparatus of FIGS. 1 and 2 after completion of the filling process.

As shown in the sectional views of FIGS. 1, 2 and 3, the apparatus includes a melt container 1 having a bottom outlet 4 which is selectively opened and closed by a closure plug 3 which is vertically movable by a piston and cylinder arrangement 2 coupled to the upper end of plug 3 by a linkage arrangement. The interior space 5 of the melt container communicates with an inlet pouring gate 7 of the melt container via a passage 6 which is near the bottom of the container. Providing the passage 6 near the bottom of the container prevents any slag which might form at the inlet pouring gate from reaching the major interior space 5. Melt container 1 can be filled by, for example, a transportable melt container 9 having an outlet 8 so that the melt container 1 can be refilled as necessary with melt 29.

The bottom outlet includes a plug or pouring spout 10 which protrudes from the bottom of the melt container 1 and which is shaped so that it can be directly joined to the inlet pouring gate 22 of a casting mold 15 in closely mating relationship, spout 10 being molded or otherwise integrally attached to the underside of container 1. Spout 10 includes a discharge bore 28, and it will be observed that bore 28 has a specific predeterminable interior volumetric capacity between the distal end of bore 28 and the valving end of plug 3. A pouring channel 24 in casting mold 15 extends between gate 22 and the mold cavity which is to be filled with melt. In order to make optimal flow conditions of the outpouring melt possible, the cross section of the outlet bore 28 of the bottom outlet 4 is made of a larger diameter than channel 24 of the casting mold 15.

One or more weighting elements 14 are attached to the underside of the melt container 1 in order to absorb the peristatic pressure during filling. These weighting elements 14 may be developed either as movable weights or alternatively as spring-loaded elements or loadable under the action of the weight of melt container 1.

As inductive heating apparatus, not shown, can be provided for both the inside space 5 of the melt container as well as for the bottom outlet 4, depending upon the filling intervals of the casting mold 15 and also taking into consideration the size of melt container 1.

In the embodiment shown, the melt container 1 is provided with support means permitting the melt container to be movable in a vertical direction and can also be provided with means permitting the container to be movable horizontally or in some other plane which permits the melt container to be moved into a precise filling position relative to the casting mold. As will be recognized, it is also possible to construct the casting mold 15 so that it can likewise be moved into filling position relative to the melt container 1, or both the melt container and the casting mold 15 can be independently or mutually movable into filling position. It will be seen that this movement is necessary to permit precise alignment of the pouring spout and gate.

In the embodiment of FIG. 1, pneumatically or hydraulically acting lifting cylinders 16 are provided for the vertical movement of the melt container 1 on both sides of the casting mold 15, the cylinders being connected by their piston rods 19 to a carrier frame 17 which receives the melt container 1. The cylinders 16 are supported by frame portions 18 which can be mounted, for example, horizontal movement of the mechanism including components 16 and 17 carrying the melt container. Alternatively, mechanical or electromechanical operating arrangements can be employed.

The casting mold 15 is supported by a base plate 20 which can conveniently be arranged on a roller conveyor track 21. The pouring gate 22 which is mounted in the upper surface 32 of mold 15 is to be aligned with the bottom outlet 4 of the melt container in the pouring position. It will also be recognized that other transportation mechanisms such as a plate conveyor belt can be provided in place of the roller track 21, depending upon the size and type of casting mold 15. The casting mold itself can be in a form box but need not have any box.

Figure 4:
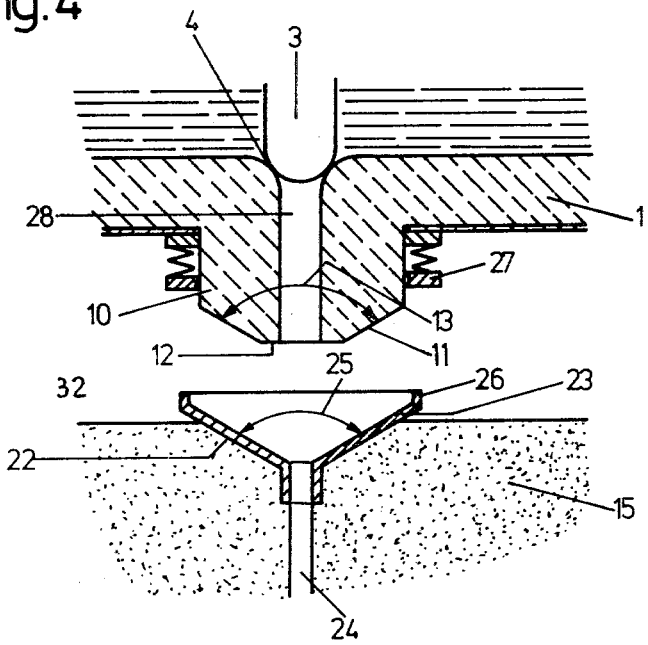
FIG. 4 is an enlarged side elevation, in section, of the filling spout, separatory body and mold gate portions of the apparatus of FIGS. 1–3.

FIG. 4 shows an enlarged view of the pouring parts of the melt container such as employed in FIGS. 1–3 in aligned position with the melt receiving portions of the casting mold 15. Spout 10 of the pouring part, molded onto the melt container 1, is in this case formed as a protruding cylindrical spout and has a frustoconically shaped distal end portion 11, the smaller portion of portion 11 being toward the distal end of interior bore 28. The angle 13 of the frustoconical end 11 of the spout is preferably made to be an obtuse angle.

A separating body 23, which has a cone-shaped funnel portion with a tubular pipe-like extension integrally formed on the smaller end thereof, is inserted into the generally conical pouring gate 22 of the casting mold 15. The separating body engages with the pouring channel 24 of the pouring gate 22 and the funnel portion rests in the pouring gate which is dimensioned and formed to mate therewith and comprises an indentation in the casting mold 15. The separating body 23 is advantageously made of a sheet material sufficiently heat resistant, such as asbestos sheet or fabric, steel sheet, chamotte sand molded with clay or a resinous binder etc.; preferably cardboard or a papier-mache pressing impregnated with zircon wash or a solution of sodium silicate may be used, such material having sufficient separating ability and stability until the melt has been poured into the mold.

The conical angle 25 of the funnel portion of the separating body as well as the angle of the conical indentation defining the pouring gate are selected to be identical to the angle of cone 13 of portion 11 of the pouring spout so that these components when brought into contact with each other closely mate, and the largest diameter of the pouring gate 22 is selected to be approximately equal to the diameter of the exterior of pouring spout 10 of the bottom outlet.

The hollow interior volume of the funnel portion of the separating body 23 has been selected to be a predetermined amount larger than the volumetric capacity of the outlet bore 28 of spout 10 with the result that after closure of the discharge bore 28 by plug 3 and lifting off of the melt container 1 from the casting mold, that portion of the melt still remaining in the discharge bore 28 can run into the funnel part without overflowing or splashing.

The outside edge of the funnel part of the separating body 23 in this embodiment is developed with an upwardly extending cylindrical reinforcement rim 26 on which a resilient support ring 27 can engage. Ring 27 is releasably placed around spout 10, the purpose of the support ring being to urge the separating body away from the melt container as the container is lifted away from the casting mold after the filling operation. Additionally, the support ring 27 can perform the function of causing the separating body 23 to fit flush in the pouring gate 22 prior to tight joining of the pouring spout to the separating body in order to guarantee a tight fit between the components. For this purpose, ring 27 is downwardly urged by a compression spring, the other end of which abuts the lower portion of the melt container against a seating ring.

Figure 5:
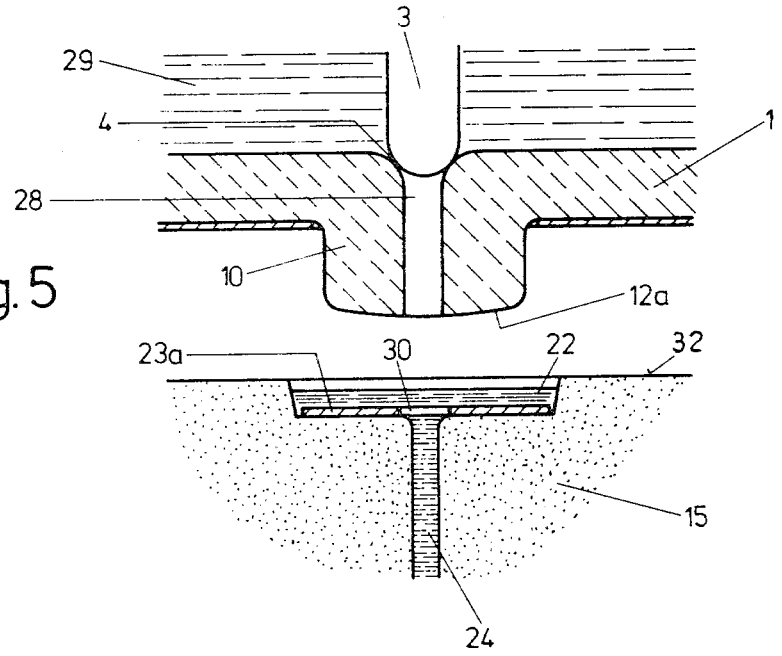
FIG. 5 is an enlarged side elevation of the spout and gate portion showing a further embodiment thereof in accordance with the invention.

FIG. 5 shows a further embodiment of the pouring spout, separating body and pouring gate portions of the apparatus in the aligned position. The spout 10 attached to the melt container in this embodiment is preferably made so that the distal end **12*a* is slightly convex around the outlet end of discharge bore 28, but may alternatively be made flat. The pouring gate 22 is formed as a frustum-shaped or cylindrical indentation for the reception of a separating body 23*a* which is shaped as a flat plate. A central bore 30 is provided in the separating plate and is arranged so that it is coaxial with the pouring channel 24, the diameter of bore 30 being dimensioned to correspond with the diameter of the pouring channel. Again, the separating body is formed of a heat-resistant working material and can be any one of a variety of working material compositions suitable for use with the particular melt 29 which is to be poured. The outside shaping of the separating body 23*a* is made to correspond to the spout 10** of the melt container which, in the embodiment shown, is round, but it may also be some other geometrical form such as polygonal. Thus, individual parts of the periphery of the separating body 23*a* during joining of the components are pressed, with the spout 10, into the molding material of the casting mold in order to bring about an adhesion in the pouring gate 22. The shaping of the plate-shaped separating body 23*a* is largely adapted to the size of the casting mold 15 and may therefore also be provided as a loose disc inserted into the pouring gate 22 wherein it has also been taken into consideration to produce this separating body 23*a* with a certain shaping resiliently or plastically or from a material changeable as to temper.

Again, the dimensions of the pouring gate 22 are again selected such that the volumetric capacity of the hollow space formed thereby is greater than the volumetric capacity of bore 28 below the closing end of plug 3 so that melt material remaining therein after filling of the mold can be received by the gate without overflow.

Figure 6:
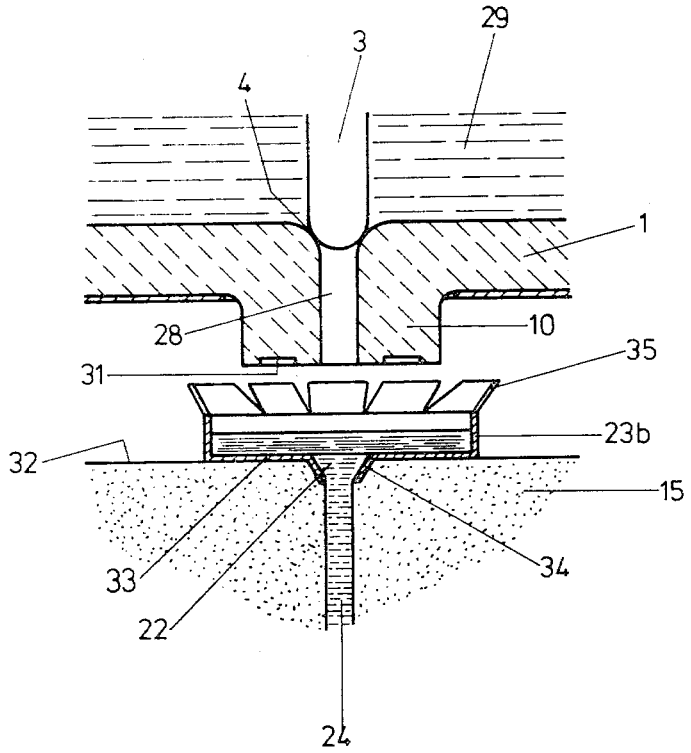
FIG. 6 is an enlarged side elevation, in section, of the spout and gate portion of the apparatus showing a still further embodiment thereof.

A further embodiment is shown in FIG. 6 wherein the spout 10 has a flat distal end and can be provided as a sealing surface with an annular groove 31 formed therein.

The pouring gate 22 in this embodiment is formed as a conical enlargement of the upper end of pouring channel 24. Over the pouring channel 22 and resting on the upper surface 32 of the casting mold 15, there is provided a separating body 23*b* which is formed as a cylindrical hollow body having a bottom surface 33 from which extends a generally conical discharge spout 34, the exterior of which is shaped and dimensioned to be tightly and matingly received by the frustoconical pouring gate 22. The upper edge of the periphery of the upwardly opening cylindrical portion of the separating body is provided with a wreath of resilient supporting members comprising a plurality of flaps 35 for the purpose of repelling the separating body 23*b* from the melt container as the melt container is lifted away from the casting mold after the filling process.

As in the previously discussed embodiments, the volumetric capacity of the cylindrical portion of the separating body 23*b* is chosen to be a predetermined amount larger than the known volumetric capacity of that portion of discharge bore 28 below plug 3 so that the separating body can receive any melt remaining in bore 28 after filling.

Figure 7:
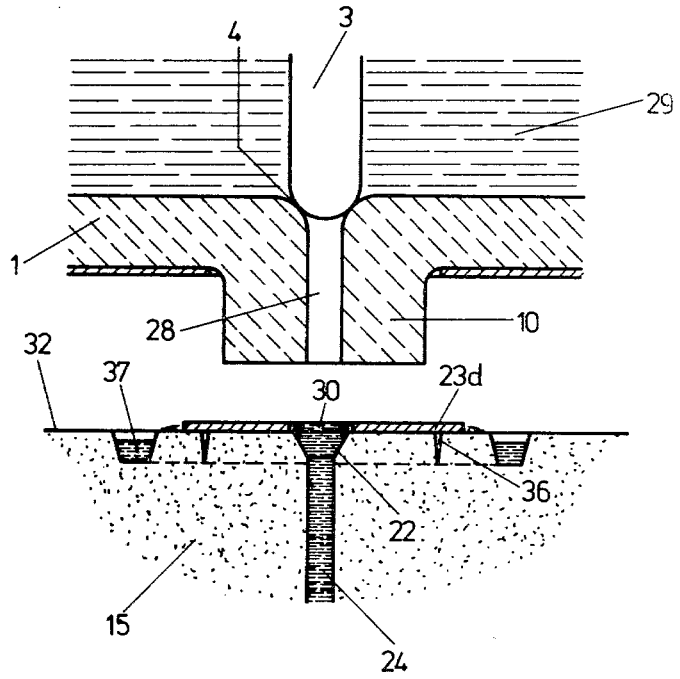
FIG. 7 is an enlarged side elevation, in section, of the spout and gate portions of the apparatus showing yet another embodiment thereof.

FIG. 7 shows a further embodiment of the invention, also shown in the aligned condition. In this embodiment a plate-shaped separating body 23*d* is provided resting on the upper surface 32 of the casting mold 15, the body again having a bore 30 coaxially related to the funnel-shaped pouring gate 22 of the casting mold. In order to fixedly locate the position of the separating body, the body can be provided with a plurality of locating pegs extending downwardly into the upper surface 32 of the mold. Spout 10 which is again integrally formed with the melt container is formed with a flat discharge end, similar to FIG. 6. Surrounding the separating body 23*d* in the casting mold is an annular groove 37 which is molded into the upper surface 32, the dimensions of the groove being selected such that the volumetric capacity thereof is greater than the volumetric capacity of that portion of bore 28 below the bottom of closure plug 3.

Figure 8:
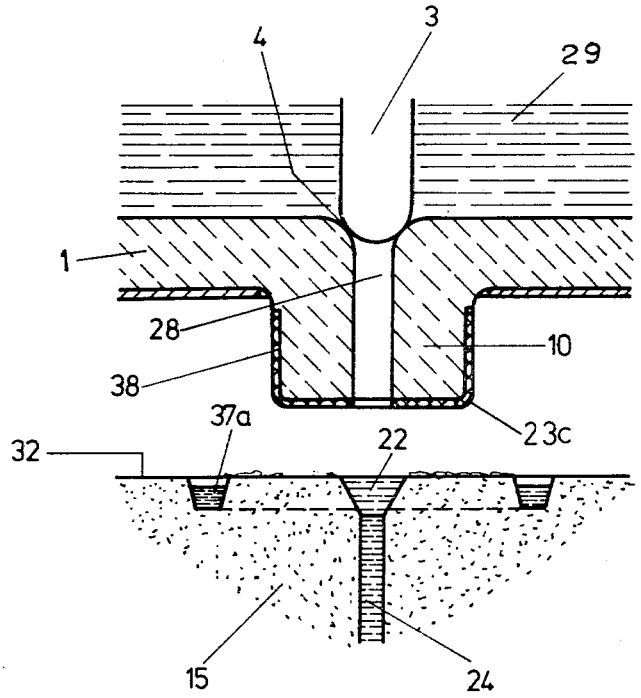
FIG. 8 is an enlarged side elevation, in section, showing a further embodiment of the spout and gate portions thereof.

Yet another embodiment is shown in FIG. 8 wherein a cohesive molded layer 38 is formed or attached to the exterior surface of spout 10 and performs the function of a separating body 23*c*. The material usable for layer 38 can be a composite material incorporating a graphite base. The shape of separating body 23*c* can be provided either as a molded layer that can be put over the end of spout 10, as shown, or alternatively as a molded layer placed in the form of a plate as part of spout 10, or else as a layer which is a solid molded layer in its final state but which can be initially put on the spout in its plastic state.

A funnel-shaped pouring gate 22 is formed in the upper surface 32 of the casting mold 15 coaxially related to the discharge bore 28 of the spout 10 of the melt container. Outside the range of contact of the end of spout 10 with the casting mold 15, and preferably concentrically with pouring gate 22, an annular indentation 37*a* is molded in the casting mold 15, the dimensions of which are again selected to have a volumetric capacity greater than that portion of bore 28 below the end of closure plug 3.

When the separating body 23 or 23*b* is formed as a hollow body, it is possible to provide the inside of the hollow body with a coating of an inoculating agent with which the melt 29 can be inoculated concurrently during the filling process.

As will be recognized, it is entirely possible to use a melt container 1 which has a plurality of bottom outlets and wherein a corresponding plurality of input pouring gates 22 are provided in the casting mold 15 with each pouring gate aligned with one of the outlet spouts. In this connection, the discharge bores 28 of the bottom outlets may also be variable in order to guarantee a harmonization with the casting system.

The method of operation of the arrangements described consist essentially in that a casting mold 15 with its pouring gate 22 is moved below the melt container 1 into aligned position with the bottom outlet with a separating body according to any one of the embodiments shown inserted coaxially with the pouring gate or, alternatively, with the separating body connected to the spout end of the bottom outlet.

Subsequently, the melt container is lowered onto the casting mold 15 by operation of the lifting cylinders 16 so that a tight mating relationship exists between the bottom outlet, the separating body and the casting mold. The pressure exerted thereon by the weight of the melt containers is determined by variation of the lowering level of the melt container 1 by means of control of the lifting cylinder 16, and acts at the same time as part of the weighting of the casting mold 15. The remaining part of the weighting is accomplished by the weighting elements 14 attached to the underside of the melt container 1.

In this sector of the filling position, the closure is opened by lifting of the closure plug 3 and melt 29 can flow under practically uniform ferrostatic pressure into the casting mold 15 to fill the cavity therein. The practically uniform ferrostatic pressure is the result of the fact that melt container 1 in this case excercises the function of a pouring basin.

The time required for the filling process is determined by the volumetric capacity of the casting mold and, as a result, there is no need for any form of dosing arrangement or a filling level control. Since the filling process takes place in a closed system, oxidation of a melt as it passes from a melt container into the casting mold is impossible and temperature losses as well as splashing or spraying of the melt, referred to as "spray iron" can be avoided.

After the filling process is completed, the closure plug is lowered to close the melt container outlet and the melt container is raised by operation of the lifting cylinder 16. The residual melt remaining in the hollow body is quite small since the pouring gate 22 may be kept relatively small. As a result, a favorable relationship of good casting to the need of liquid metal has been created.

The advantages achievable with the arrangement of the invention include the fact that the melt container in this case exercises the function of pouring basin as a result of which is practically uniform ferrostatic pressure is maintained during in-flow into the casting mold and a high precision of weight and reproducibility of the filling quantity with a favorable ratio of good casting to need of liquid metal may be achieved without special control arrangements. Since the filling of the casting mold takes place in a closed system, oxidation of the melt as well as temperature losses and spray iron of the melt can be avoided without additional apparatus. The simple construction permits the use of both cycled as well as continuous molding and casting installations wherein a universal use for filling of molds exists.

While certain advantageous embodiments have been chosen to illustrate the invention, it will be understood by those skilled in the art that various changes and modifications can be made therein without departing from the scope of the invention as defined in the appended claims.

What is claimed is:

1. An improved apparatus for gravity filling a casting mold with melt, the apparatus being of the type having a melt container having at least one bottom outlet spout and a closure plug and the casting mold having at least one pouring channel and pouring gate opening at an upper surface of the casting mold wherein the improvement includes means for supporting said melt container and said casting mold so that at least one of said container and mold is vertically movable relative to the other to align the bottom outlet spout with and adjacent to the pouring gate; and a separating body disposed between said bottom outlet spout and said pouring gate for intimate contact with said spout and gate during pouring for passage of melt therethrough, said separating body being shaped to conform to the shapes of said bottom outlet spout and said pouring gate and being formed from a material selected to facilitate separation of said outlet spout from said mold.

2. An apparatus according to claim 1 wherein said bottom outlet has a discharge bore having a predetermined volumetric capacity between said closure plug and the distal end thereof, and said separating body includes means defining a hollow receptacle having a capacity greater than said predetermined capacity of said bore.

3. An apparatus according to claim 1 wherein said bottom outlet has a discharge bore having a predetermined volumetric capacity between said closure plug and the distal end thereof, and said pouring gate includes means at the inlet end thereof for defining a receptacle having a capacity greater than said predetermined capacity of said bore.

4. An improved apparatus for gravity filling a casting mold with melt, the apparatus being of the type having a melt container having at least one bottom outlet and a closure plug and the casting mold having at least one pouring channel and pouring gate opening at an upper surface of the casting mold wherein the improvement includes means for supporting said melt container and said casting mold so that at least one of said container and mold is movable relative to the other to align the bottom outlet with the pouring gate; and a separating body disposed between said bottom outlet and said pouring gate for passage of melt therethrough, said separating body being shaped to conform to at least one of the shapes of said bottom outlet and said pouring gate and being formed from a material selected to facilitate separation of said spout from said mold, and wherein said bottom outlet has a discharge bore having a predetermined volumetric capacity between said closure plug and the distal end thereof, said casting mold including means in the upper surface thereof defining a generally annular channel surrounding said pouring gate, said channel having a capacity greater than said predetermined capacity of said bore.

5. An apparatus according to claim 1 wherein said separating body comprises a generally frustoconical hollow body having a tubular portion extending from the smaller end thereof.

6. An apparatus according to claim 1 wherein said separating body is a plate-shaped member having a central bore, the diameter of said bore being at least as large as the pouring channel in said mold.

7. An apparatus according to claim 1 wherein said bottom outlet includes a generally cylindrical spout body protruding downwardly from the bottom of said melt container, said body having a central bore and a conical distal end;

said pouring gate comprises means defining a frustoconical recess leading to said pouring channel; and said separating body comprises a frustoconical hollow body received in said frustoconical recess;

and wherein the conical angles of said distal end of said spout body, said recess and said separating body are substantially identical.

8. An apparatus according to claim 9 wherein said conical angles are obtuse.

9. An improved apparatus for filling a casting mold with melt, the apparatus being of the type having a melt container having at least one bottom outlet and a closure plug and the casting mold having at least one pouring channel and pouring gate opening at an upper surface of the casting mold wherein the improvement includes means for supporting said melt container and said casting mold so that at least one of said container and mold is movable relative to the other to align the bottom outlet with the pouring gate; and a separating body disposed between said bottom outlet and said pouring gate for passage of melt therethrough, said bottom outlet including a generally cylindrical spout body protruding downwardly from the bottom of said melt container;

a support ring surrounding said spout body, said ring being alignable with said separating body; and means for resiliently urging said ring toward said separating body.

10. An improved apparatus for filling a casting mold with melt, the apparatus being of the type having a melt container having at least one bottom outlet and a closure plug and the casting mold having at least one pouring channel and pouring gate opening at an upper surface of the casting mold wherein the improvement includes means for supporting said melt container and said casting mold so that at least one of said container and mold is movable relative to the other to align the bottom outlet with the pouring gate; and a separating body disposed between said bottom outlet and said pouring gate for passage of melt therethrough, said separating body comprising a hollow upwardly opening body supported at said pouring gate, said body having a plurality of generally upwardly extending flaps resiliently connected to said body for urging said body away from said bottom outlet.

11. An improved apparatus for filling a casting mold with melt comprising the combination of a melt container having a bottom outlet, said outlet including an outlet spout protruding downwardly from a bottom surface of said container and having a central bore through which melt can pass, and a closure plug in said container, said plug being movable toward and away from the inner end of said bore to selectively permit passage of melt therethrough;

a casting mold including a mold cavity to be filled with melt from said container, a pouring gate at an upper surface of said mold to receive melt from said spout, and a pouring channel interconnecting said gate and said cavity;

means for supporting said melt container and said casting mold for relative movement therebetween to permit alignment of said bore and said gate and to permit said spout to be moved into mating proximity with said gate; and a separating body carried by one of said spout and said gate and having an opening therethrough to facilitate separation of said spout from said gate after filling said cavity, said spout, said gate and said separatory body being shaped to closely mate with each other so that they can be brought into mutual contact with said body between said spout and said gate whereby melt can pass directly from said spout through said body and into said gate, and said body being formed from a material selected to facilitate separation of said spout from said mold.

* * * * *